US005181246A

United States Patent [19]

Miki

[11] Patent Number: 5,181,246

[45] Date of Patent: Jan. 19, 1993

[54] PRIVACY COMMUNICATION DEVICE

[75] Inventor: Tsutomu Miki, Itami, Japan

[73] Assignee: Mitsubishi Denki Kabushiki Kaisha, Tokyo, Japan

[21] Appl. No.: 746,017

[22] Filed: Aug. 12, 1991

[30] Foreign Application Priority Data

Aug. 20, 1990 [JP] Japan ..... 2-220658

[51] Int. Cl.[5] ..... H04K 1/00

[52] U.S. Cl. ..... 380/34

[58] Field of Search ..... 380/34, 39; 375/1

[56] References Cited

U.S. PATENT DOCUMENTS

| | | | |
|---|---|---|---|
| 4,068,094 | 1/1978 | Schmid et al. | 380/39 |
| 4,188,506 | 2/1980 | Schmid et al. | 380/39 |
| 4,525,844 | 6/1985 | Scheuermann | 380/39 |
| 4,790,009 | 12/1988 | Ishigaki et al. | 380/39 |

*Primary Examiner*—Salvatore Cangialosi

*Attorney, Agent, or Firm*—Oblon, Spivak, McClelland, Maier & Neustadt

[57] ABSTRACT

A privacy communication device uses a control channel (5) in addition to a voice channel (4) in communicating with other privacy communication device. Each privacy communication device employs a ring modulator (8) and a ring democulator (14). A specific modulator carrier frequency to be given to the ring modulator (8) is selected by function of a control signal transmitted on the control channel (5) out of a plurality of modulator carrier frequencies prepared in advance. Likewise, a specific demodulator carrier frequency to be given to the ring democulator (14) is selected by function of a control signal transmitted on the control channel (5) out of a plurality of demodulator carrier frequencies prepared in advance.

Hence, when the specific modulator carrier frequency and the specific demodulator carrier frequency are updated at arbitrary intervals, a third person cannot easily identify the varied modulator carrier frequency and demodulator carrier frequency. Thus, secrecy of a voice signal transmitted through the voice channel (4) between the two privacy communication devices is enhanced.

14 Claims, 6 Drawing Sheets

PRIVACY COMMUNICATION DEVICE

BACKGROUND OF THE INVENTION

1. Field of the Invention

The present invention relates to a privacy communication device in radio communication for preventing any third person from tapping communications.

2. Description of the prior Ar

FIG. 1 is a block diagram showing a conventional privacy communication device as mentioned above. As shown in FIG. 1, a voice input signal "a" applied to a voice input terminal 6 is amplified in an input amplifier 7 and modulated in a ring modulator 8 producing double side band. An output signal "b" from the ring modulator 8 is inputted to a low-pass filter 9 for filtering the double side band to pass lower side band alone, and an output signal received from the low-pass filter 9 is amplified in an output amplifier 10 and applied as an output signal "c" to a privacy voice output terminal 11.

Then, a privacy voice input signal received from a privacy voice input terminal 12 is amplified in an input amplifier 13 and demodulated in a ring demodulator 14 producing double side band. An output signal "d" from the ring demodulator 14 is inputted to a low-pass filter 15 for filtering the double side band to pass lower side band alone, and an output signal from the low-pass filter 15 is amplified in an output amplifier 16 and then applied as a voice output signal "e" to a voice output terminal 17.

A carrier generator 25 applies a modulator carrier frequency signal 23 to the ring modulator 8 and a demodulator carrier frequency signal 24 to the ring demodulator 14.

FIG. 1 shows a system architecture of one of two privacy communication devices to communicate each other; the other not shown in the drawing also has the same architecture.

A privacy voice output signal from the privacy voice output terminal 11 shown in FIG. 1 is transmitted through a radio transmitter (not shown) to the privacy communication device remotely positioned not shown in the drawing and applied through a radio receiver to a privacy voice input terminal of the remote privacy communication device. Also, a privacy voice output signal from the privacy voice output terminal of the remote privacy communication device not shown in the drawing is transmitted from a radio transmitter built in the remote privacy communication device through a radio receiver (not shown) of the privacy communication device shown in FIG. 1 to the privacy voice input terminal 12.

Then, the operation of the devices will be described. First, the voice input signal "a" inputted from the voice input terminal 6 is amplified by the input amplifier 7 and applied to the ring modulator 8. From the amplified voice input signal "a", the ring modulator 8 produces two side bands "b", upper and lower bands with the center of the modulator carrier frequency signal 23 received from the carrier generator 25. The low-pass filter 9 pass only the lower band of the upper and lower bands, and the signal is amplified in the output amplifier 10 and outputted as the privacy voice output signal "c" from the privacy voice output terminal 11.

The privacy voice input signal inputted from the privacy voice input terminal 12 is amplified by the input amplifier 13 and applied to the ring demodulator 14. From the amplified voice input signal, the ring demodulator 14 produces two side bands "d", upper and lower bands with the center of the demodulator carrier frequency signal 24 received from the carrier generator 25. The low-pass filter 15 passes only the lower band of the two side bands, upper and lower bands. The signal is amplified in the output amplifier 16 and outputted as the privacy voice output signal "e" from the voice output terminal 17.

The modulator carrier frequency signal 23 and the demodulator carrier frequency signal 24 applied to the ring modulator 8 and the ring demodulator 14, respectively, are identical in frequency.

FIGS. 2 (*a*)–(*e*) are diagrams showing frequency spectrums of the signals "a" through "e" produced by the conventional privacy communication device. FIG. 2 (*a*) shows a frequency spectrum of the voice input signal applied to the voice input terminal 6, FIG. 2 (*b*) shows a frequency spectrum of the output of the ring modulator 8, FIG. 2 (*c*) shows a frequency spectrum of the privacy voice output signal outputted from the privacy voice output terminal 11, FIG. 2 (*d*) shows a frequency spectrum of the output of the ring demodulator 14, and FIG. 2 (*e*) is a frequency spectrum of the voice output signal from the voice output terminal 17.

As shown in FIGS. 2 (*a*)–(*e*), the ring modulator 8 produces two frequency spectrums of the upper and lower bands shown in FIG. 2 (*b*) of the voice input signal "a" shown in FIG. 2 (*a*).

Then, the low-pass filter 9 passes the lower band alone of the two frequency spectrums of the upper and lower bands produced by the ring modulator 8 and produces the privacy voice output signal "c" through the output amplifier 10. The frequency spectrum of the privacy voice output signal "c" has a profile which is the inversion of a profile of the frequency spectrum of the voice input signal "a".

Also, the ring demodulator 14 produces the two frequency spectrums in FIG. 2 (*d*) of the upper and lower bands of the privacy voice input signal "c" amplified by the input amplifier 13.

Then, the low-pass filter 15 passes the lower band alone of the upper and lower bands produced by the ring demodulator 14, and the voice output signal "e" from the low-pass filter 15 through the output amplifier 16 is outputted from the voice signal output terminal 17. The voice output signal "e" has a profile which is the inversion of a profile of the frequency spectrum of the privacy voice input signal "c" and which is identical with a profile of the frequency spectrum of the voice input signal "a".

As has been described, a frequency spectrum on the transmitting side is applied to the receiving side after it is inverted in the ring modulator 8 and low-pass filter 9 on the transmitting side, while the frequency spectrum received on the receiving side is inverted again in the ring demodulator 14 and low-pass filter 15 on the receiving side to reproduce the frequency spectrum of the transmitting side.

The ring modulator 8 and the ring demodulator 14 can be formed of the identical circuitry, and they carry out modulation and demodulation in accordance with carriers of the identical frequency. FIG. 3 is a circuit diagram showing an exemplary architecture of the ring modulator 8 and ring demodulator 14. As shown in the diagram, a voice input signal or a privacy voice input signal is inputted from a voice signal input terminal 26, while the modulator carrier frequency signal 23 or the demodulator carrier frequency signal 24 is inputted from a carrier signal input terminal 27. The voice signal input terminal 26 is connected through analog switches 28 and 30 to a negative phase input terminal "−" and a positive phase input terminal "+" of a differential amplifier 33, respectively.

A ground level is connected through analog switches 29 and 31 to a negative phase input terminal "−" and a positive phase input terminal "+" of the differential amplifier 33, respectively.

Moreover, under the control of the modulator carrier frequency signal 23 or demodulator carrier frequency signal 24 received from the carrier signal input terminal 27, the analog switches 28 and 31 become conductive or nonconductive, while under the control of the modulator carrier frequency signal 23 or demodulator carrier frequency signal 24 inverted by a logic inverter 32, the analog switches 29 and 30 become conductive or nonconductive.

Output of the differential amplifier 33 is applied to a modulated/demodulated signal output terminal 34.

The operation of the ring modulator 8 or ring demodulator 14 is as follows: When the modulator carrier frequency signal 23 or demodulator carrier frequency signal 24 inputted from the carrier signal input terminal 27 is at high level, a voice signal from the voice signal input terminal 26 is applied through the analog switch 28 to the negative phase input "−" of the differential amplifier 33 while a ground potential is applied through the analog switch 31 to the positive phase input "+" of the differential amplifier 33.

On the contrary, when the modulator carrier frequency signal 23 or demodulator carrier frequency signal 24 inputted from the carrier signal input terminal 27 is at low level, the voice signal from the voice signal input terminal 26 is applied through the analog switch 30 to the positive phase input "+" of the differential amplifier 33 while the ground potential is applied through the analog switch 29 to the negative phase input "−" of the differential amplifier 33.

For the reason, when the modulator carrier frequency signal 23 or demodulator carrier frequency signal 24 inputted from the carrier signal input terminal 27 is at high level, the amplitude of the voice input signal from the voice signal input terminal 26 deviates from the reference of the ground potential to negative side, contrarily, when the modulator carrier frequency signal 23 or demodulator carrier frequency signal 24 is at low level, the amplitude of the voice input signal deviates from the reference of the ground potential to positive side. In this way, the voice input signal is modulated in accordance with carrier, and the signal having the frequency of the carrier suppressed is taken out from the modulated/demodulated signal output terminal 34 as output of the ring modulator 8 or ring demodulator 14.

The conventional privacy communication device is configured as previously mentioned, and therefore, there arises the problem that communications through a plurality of privacy communication devices are easily tapped by any third person who gets the modulator carrier frequency signal 23 and demodulator carrier frequency signal 24 which is generated by the carrier generator 25 and which is employed in common in the plurality of privacy communication devices.

SUMMARY OF THE INVENTION

According to the present invention, a privacy communication device comprises a modulator for modulating a voice signal to be transmitted by radio in accordance with a carrier, a demodulator for demodulating a modulated voice signal to be received by radio in accordance with the carrier, carrier generating means for producing carrier of a specific frequency specified in accordance with a control signal out of a plurality of frequencies prepared in advance and applying it to the modulator and to the demodulator, and control signal transmitting and receiving means for transmitting and receiving the control signal by radio through a channel different from a voice channel.

In accordance with the present invention, a third person cannot easily identify a frequency of carrier because the carrier of a specific frequency specified in accordance with a control signal out of a plurality of frequencies prepared in advance is produced and applied to a modulator and a demodulator.

Accordingly, it is an object of the present invention to provide privacy communication devices through which communications cannot be easily tapped by any third person.

Although the present invention has been described and illustrated in detail, it is clearly understood that the same is by way of illustration and example only and is not to be taken by way of limitation. The spirit and scope of the present invention should be limited only by the terms of the appended claims.

DETAILED DESCRIPTION OF THE PREFERRED EMBODIMENT

Figure 1:
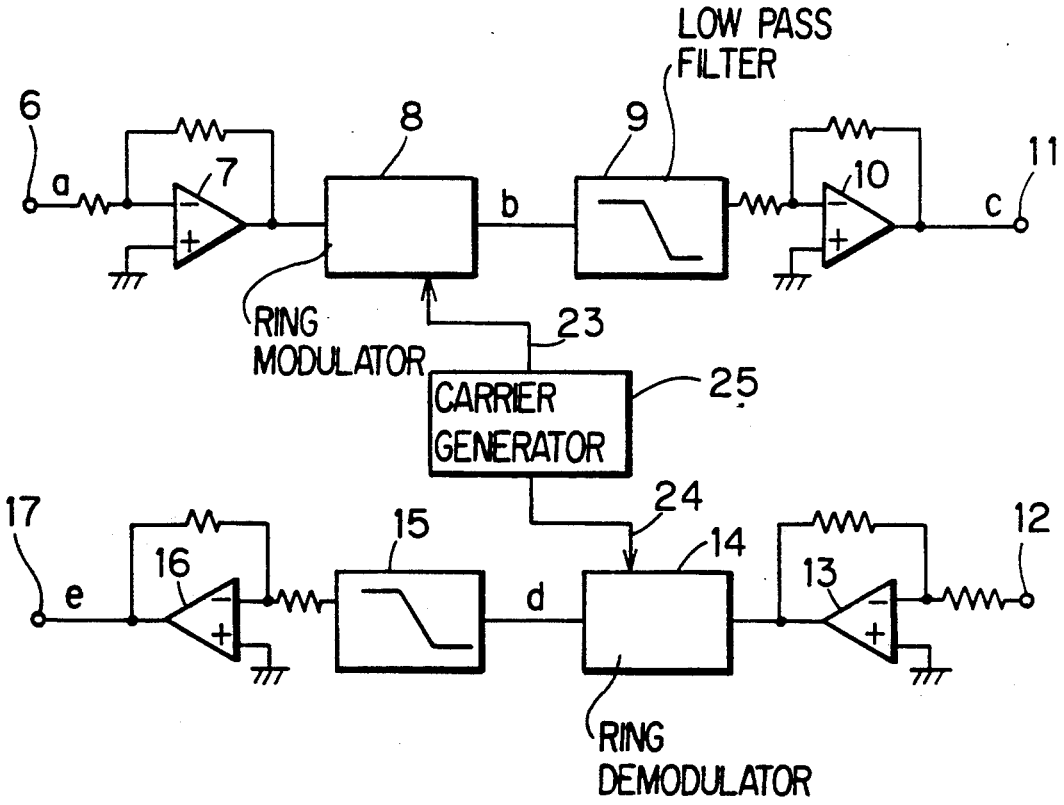
FIG. 1 a block diagram showing a conventional privacy communication device.
Figure 2A:
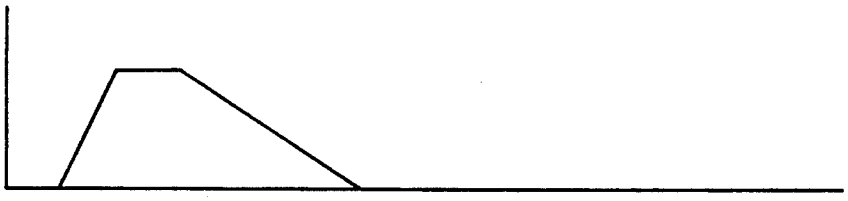
FIG. 2 is a diagram showing frequency spectrums in parts of the privacy communication device shown in FIG. 1.
Figure 2B:
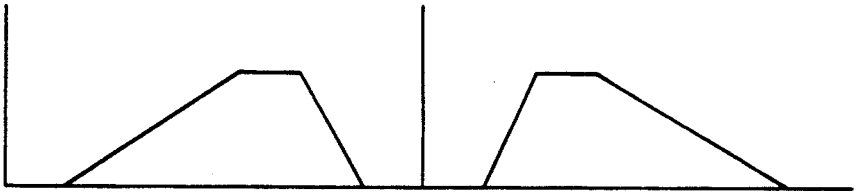
Figure 2C:
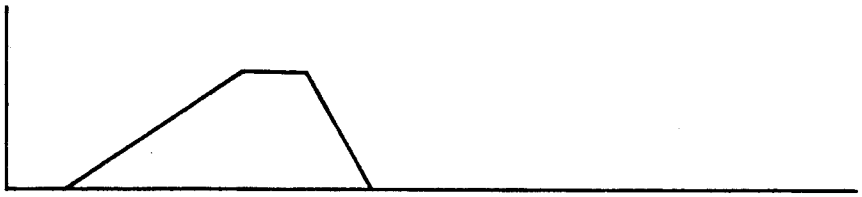
Figure 2D:
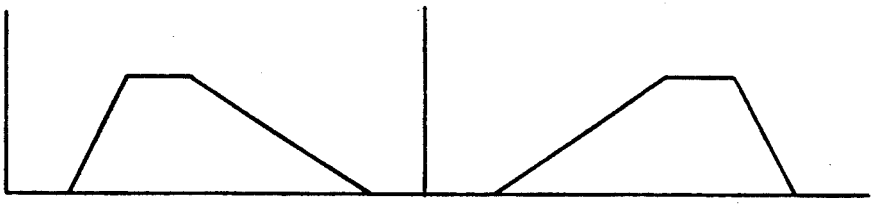
Figure 2E:
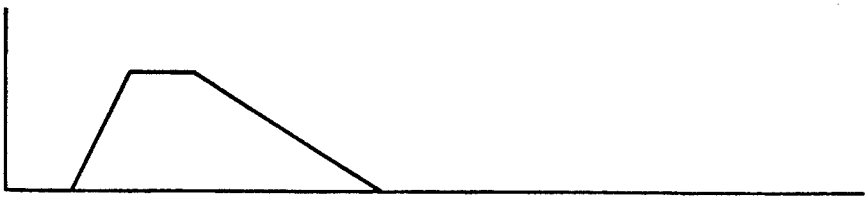
Figure 3:
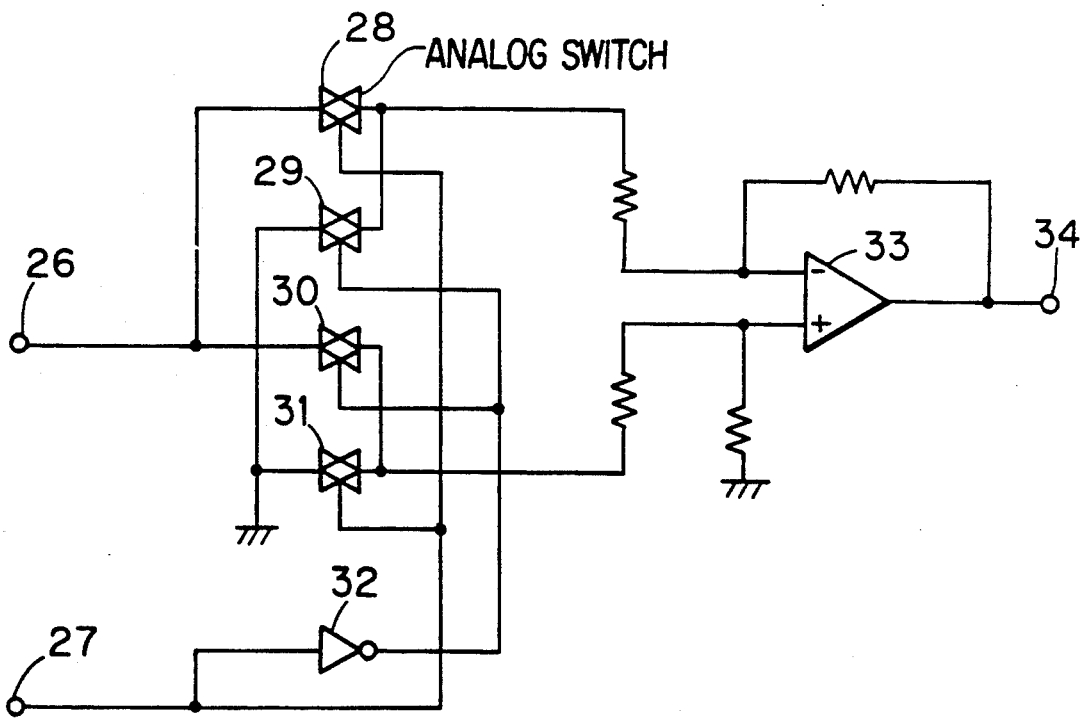
FIG. 3 is a circuit diagram showing an exemplary system architecture of a ring modulator and a ring demodulator.
Figure 4:
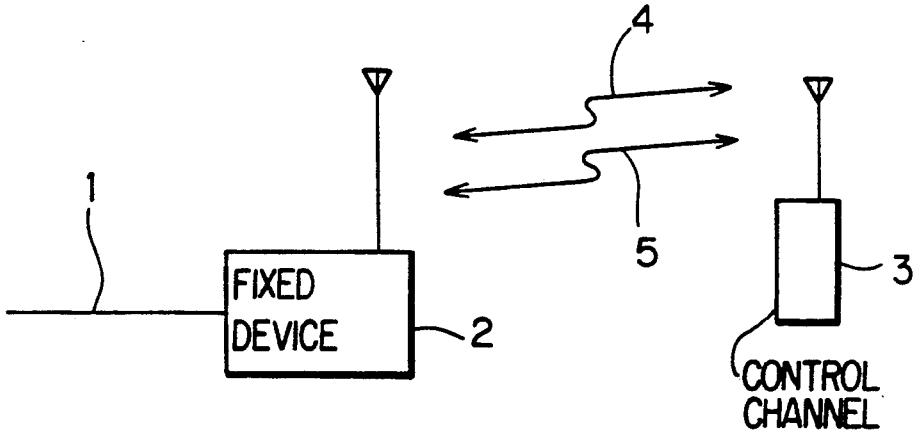
FIG. 4 is a block diagram showing a communication method between a fixed device and a portable device.

FIG. 4 is a schematic view showing a concept of an embodiment of the present invention, in which there are shown two privacy communication devices and a way of transmitting and receiving signals between them. As shown in FIG. 4, a fixed device 2 connected to a telephone line 1 and a portable device 3 transmitting and receiving signals to and from the fixed device 2 by radio are in communication with each other with a voice signal in a voice channel 4 and a control signal in a control channel 5 transmitted and received between them. The control channel 5 is employed for transmitting and receiving the control signal but the voice signal to and from the two communication devices.

Figure 5:
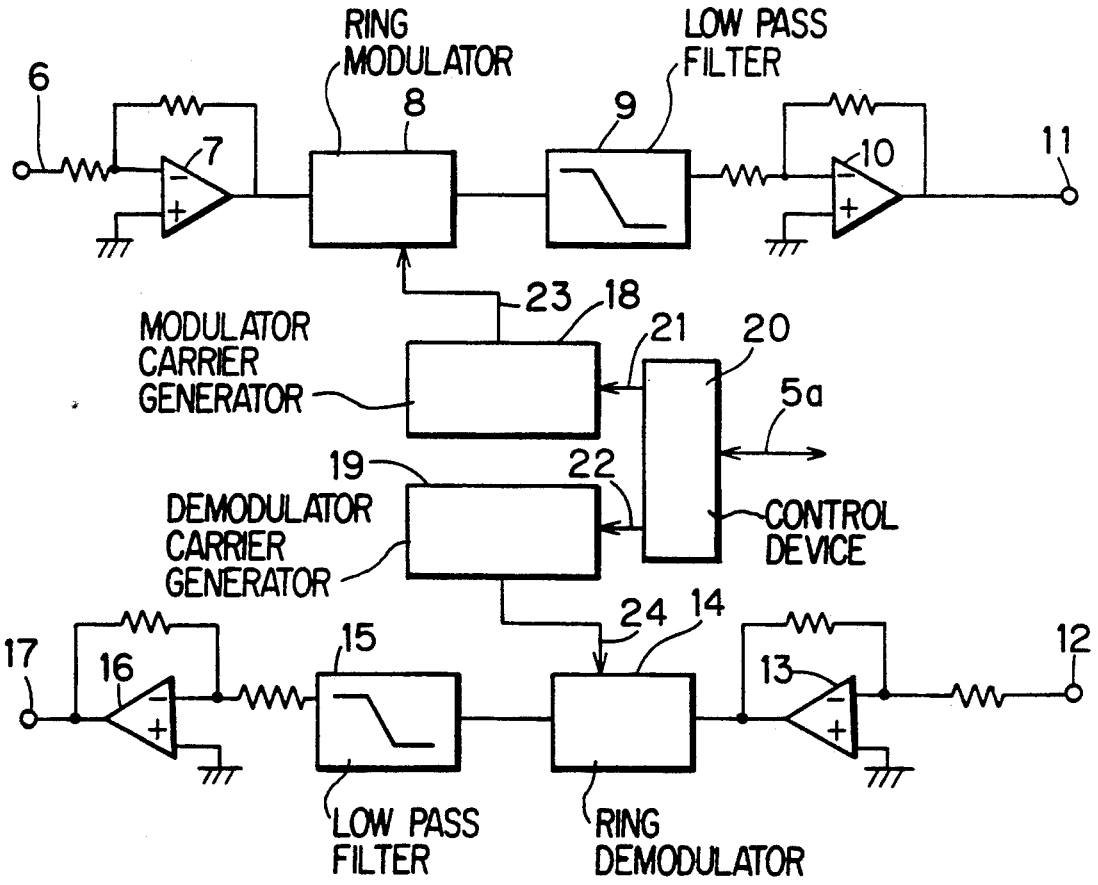
FIG. 5 is a block diagram showing a privacy communication device according to the present invention.

FIG. 5 is a block diagram showing an embodiment of a privacy communication device according to the present invention. As shown in FIG. 5, a voice input signal inputted from a voice input terminal 6 is amplified in an input amplifier 7 and modulated in a ring modulator 8 producing double side band. The signal modulated is applied to a low pass filter 9 to filter it and pass its lower side band alone, and an output signal of the low-pass filter 9 is amplified in an output amplifier 10 and applied to a privacy voice output terminal 11.

A privacy voice input signal inputted from a privacy voice input terminal 12 is amplified in an input amplifier 13 and demodulated in a ring demodulator 14. The signal demodulated is applied to a low-pass filter 15 and an output signal of the low-pass filter 15 is amplified in an output amplifier 16 and outputted as a voice output signal from a voice output terminal 17.

Moreover, control channel information 5*a* on the control channel 5 through which a control signal is transmitted and received between the two privacy communication devices by radio is provided between two control devices 20, and one of output signals of the control device 20, a modulator carrier frequency set signal 21, is applied to a modulator carrier generator 18, while the other output signal, a demodulator carrier frequency set signal 22, is applied to a demodulator carrier generator 19.

An output of the modulator carrier generator 18, a modulator carrier frequency signal 23, and an output of the demodulator carrier frequency generator 19, a demodulator carrier frequency signal 24, are applied to the ring modulator 8 and the ring demodulator 14, respectively.

FIG. 5 shows one of the two privacy communication devices in communication with each other, but the other also has the same architecture. A privacy voice output signal from the privacy voice output terminal 11 shown in FIG. 5 is transmitted through a radio transmitter (not shown) to the other privacy communication device remotely positioned and then applied through a radio receiver to a privacy voice input terminal of the privacy communication device.

A privacy voice output signal from a privacy voice output terminal of the privacy communication device remotely positioned (not shown) is applied to a radio transmitter in the privacy communication device and then transmitted through a radio receiver (not shown) in the privacy communication device shown in FIG. 5 to the privacy voice input terminal 12.

Now, the operation of the devices will be described. First, the voice input signal inputted from the voice input terminal 6 is amplified by the input amplifier 7 and applied to the ring modulator 8. From the amplified voice input signal, the ring modulator 8 produces two side bands, upper and lower bands with the center of the modulator carrier frequency signal 23 received from the modulator carrier generator 18. The low-pass filter 9 filters the two side bands, upper and lower bands, and passes the lower band alone to apply the output signal to the output amplifier 10. The output amplifier 10 amplifies the output of the low-pass filter 9 and outputs a privacy voice output signal from the privacy voice output terminal 11.

A privacy voice input signal inputted from the privacy voice input terminal 12 is amplified by the input amplifier 13 and applied to the ring demodulator 14. From the amplified privacy voice input signal, the ring demodulator 14 produces two side bands, upper and lower bands with the center of the demodulator carrier frequency signal 24 received from the demodulator carrier generator 19. The low-pass filter 15 filters the two side bands, upper and lower bands, and passes the lower band alone to apply the output signal to the output amplifier 16. The output amplifier 16 amplifies the output of the low-pass filter 15 and outputs a voice output signal from the voice output terminal 17.

Furthermore, a control signal applied through control channel information 5*a* received through the radio is transmitted and received between the control devices 20.

Assume now that in the privacy communication device shown in FIG. 5, frequencies of the modulator carrier frequency signal 23 and the demodulator carrier frequency signal 24 used in the ring modulator 8 and the ring demodulator 14, respectively, are specified in accordance with the control signal applied through the control channel information 5*a* from the other privacy communication device.

The control device 20, in this case, receives the control signal on the control channel information 5*a* from the remote privacy communication device through a radio receiver (not shown) built in the privacy communication device shown in FIG. 5, and the control signal is processed into the modulator carrier frequency set signal 21 and the demodulator carrier frequency set signal 22 and applied to the modulator carrier generator 18 and the demodulator carrier generator 19, respectively.

The modulator carrier generator 18 selects a modulator carrier frequency to be specified in accordance with the modulator carrier frequency set signal 21 out of a plurality of modulator carrier frequencies prepared in advance, and the modulator carrier frequency signal 23 of the selected frequency is transmitted to the ring modulator 8. Similarly, the demodulator carrier generator 19 selects a demodulator carrier frequency to be specified in accordance with the demodulator carrier frequency set signal 22 out of a plurality of demodulator carrier frequencies prepared in advance, and the demodulator carrier frequency signal 24 of the selected frequency is transmitted to the ring demodulator 14.

To implement accurate modulation/demodulation, it is necessary that the modulator carrier frequency and the demodulator carrier frequency are identical with each other. Thus, the modulator carrier generator 18 and the demodulator carrier generator 19 may be provided as a single common carrier generator. In this case, the common carrier generator selects the carrier frequency to be specified in accordance with a carrier frequency set signal from the control device 20 out of a plurality of carrier frequencies prepared in advance, and eventually, a carrier frequency signal of the selected frequency is transmitted to both the ring modulator 8 and the ring demodulator 14.

On the other hand, contrary to the previous case, assume that the privacy communication device in FIG. 5 specifies the modulator carrier frequency signal and the demodulator carrier frequency signal used in the ring modulator 8 and the ring demodulator 14, respectively, in accordance with a control signal on the control channel information 5*a* for the other privacy communication device remotely positioned. In this case, the control device 20, first, sets the modulator carrier frequency signal 23 and the demodulator carrier frequency signal 24 in itself and transmits a control signal for specifying the modulator carrier frequency and demodulator carrier frequency through the radio transmitter (not shown) on the control channel information 5*a* to the remote privacy communication device. The remote privacy communication device sets a modulator carrier frequency signal and a demodulator carrier frequency signal in accordance with the control signal in the manner similar to that in the privacy communication device in FIG. 5.

For transmitting and receiving a control signal on the control channel information 5*a*, one of the privacy communication devices may have priority to the other so that that privacy communication device with priority may always transmit the control signal on the control channel information 5*a* to the other device, or other communication protocols may be employed.

Figure 6:
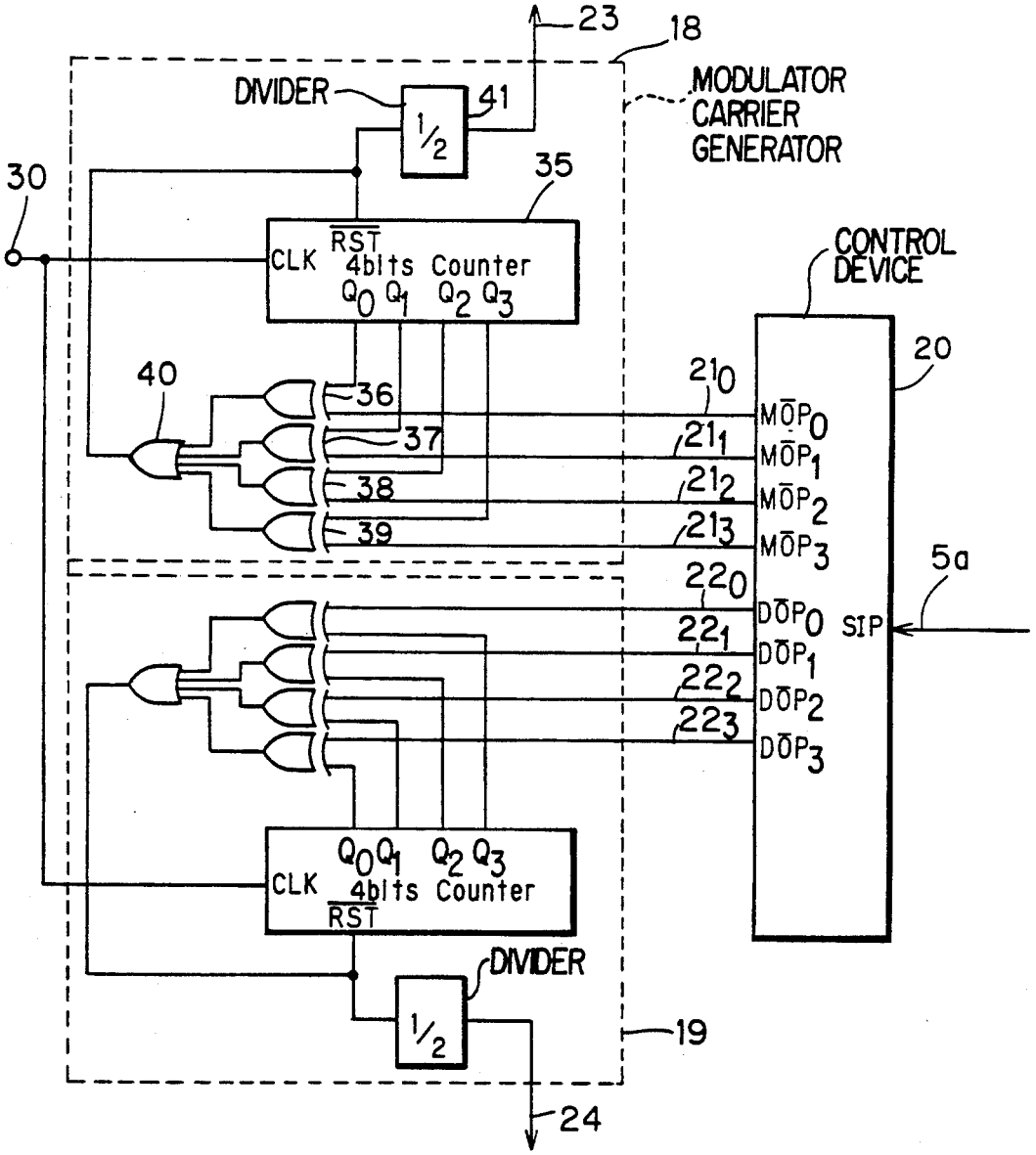
FIG. 6 is a block diagram showing details of a control device, a modulator carrier generator and a demodulator carrier generator.

FIG. 6 is a block diagram showing details of the control device 20, the modulator carrier generator 18 and the demodulator carrier generator 19 of FIG. 5. The control device 20 is consisted of a microcomputer and the like. First, control channel information 5*a* on the control channel 5 is inputted at a serial input port SIP. Out of the control channel information 5*a*, the control device 20 extracts modulator carrier frequency information and demodulator carrier frequency information which correspond to the modulator carrier frequency and the demodulator carrier frequency, respectively.

Next, the control device 20 converts the modulator carrier frequency information and the demodulator carrier frequency information into a modulator frequency dividing ratio signal and a demodulator frequency dividing ratio signal, respectively. Thus generated modulator frequency dividing ratio signal is outputted in parallel state from modulator frequency dividing ratio signal output ports $MOP_0$ to $MOP_3$ to be given to the modulator carrier generator 18 through modulator frequency dividing ratio signal lines $21_0$ to $21_3$.

Likewise, the demodulator frequency dividing ratio signal is outputted in parallel state from demodulator frequency dividing ratio signal output ports $DOP_0$ to $DOP_3$ to be given to the demodulator carrier generator 19 through demodulator frequency dividing ratio signal lines $22_0$ to $22_3$.

In addition, the modulator carrier generator 18 and the demodulator carrier generator 19 are provided with a pulse which is given thereto at a pulse input terminal 30 from crystal oscillators and the like, disposed outside the modulator carrier generator 18 and the demodulator carrier generator 19.

The modulator carrier generator 18 and the demodulator carrier generator 19 are each formed by a programmable divider. The modulator carrier generator 18 and the demodulator carrier generator 19 have the same structure, and therefor, the description below will be focused on the modulator carrier generator 18 alone. A 4-bit counter 35 is installed within the modulator carrier generator 18. A pulse inputted at the pulse input terminal 30, which is disposed outside the modulator carrier generator 18 and the demodulator carrier generator 19, is inputted to a clock input terminal CLK of the 4-bit counter 35 terminals $Q_0$ to $Q_3$ from the 4-bit counter 35 are connected with one side input terminals of exclusive OR circuits 36 to 39, respectively. Other side input terminals of the exclusive OR circuits 36 to 39 are connected with the modulator frequency dividing ratio signal lines $21_0$ to $21_3$, respectively. Output terminals of the exclusive OR circuits 36 to 39 are connected to an input terminal of an OR circuit 40.

An output terminal of the OR circuit 40 is connected with a reset input terminal $\overline{RST}$ of the 4-bit counter 35, the reset input terminal $\overline{RST}$ being based on negative logic. The output terminal of the OR circuit 40 is connected with a ½ divider 41 as well. The modulator carrier frequency signal 23 is outputted from an output terminal of the ½ divider 41 to be given to the ring modulator 8.

Now, assume that a modulator frequency dividing ratio signal on the modulator frequency dividing ratio signal lines $21_0$ to $21_3$ is "3" where the modulator frequency dividing ratio signal lines $21_0$ and $21_3$ are least significant bit (LSB) and most significant bit (MSB). respectively. In this case, the modulator frequency dividing ratio signal on the modulator frequency dividing ratio signal lines $21_0$ and $21_1$ has an "H" level value while that on the modulator frequency dividing ratio signal lines $21_2$ and $21_3$ has an "L" level value.

As a result, reverse signals of the signals outputted at the output terminals $Q_0$ and $Q_1$ of the 4-bit counter 35 are outputted from the output terminals of the exclusive OR circuits 36 and 37, respectively. On the other hand, the signals outputted at the output terminals $Q_2$ and $Q_3$ are outputted from the output terminals of the exclusive OR circuits 38 and 39, respectively.

Given that output $Q_0$ is LSB and the output $Q_3$ is MSB, a signal value outputted from the outputs $Q_0$ to $Q_3$ varies as 3, 2, 1, 0. Hence, signal outputted from the OR circuit 40 stays at "H" level for three cycles of a clock which is given to the clock input terminal CLK of the 4-bit counter 35 and which later changes to "L" level. With a signal at "L" level given to the reset signal input terminal $\overline{RST}$ (which operates on negative logic) of the 4-bit counter 35, the 4-bit counter 35 is reset to initial state.

Thus, a signal outputted from the OR circuit 40 stays at "H" level for three cycles of a clock given to the clock input terminal CLK of the 4-bit counter 35 while changing to "L" level between successive three-cycle "H" level periods.

This signal is given to the ½ divider 41 where it is divided in half. Hence, an output from the OR circuit 40 is converted into a signal with a frequency of ½ and duty of 50%. The converted signal is given as the modulator carrier frequency signal 23 to the ring modulator 8.

Thus, as the modulator carrier frequency signal 23, a ½n dividing ratio (n=1–15) of a frequency of a clock which is given to the clock input terminal CLK of the 4-bit counter 35 can be set.

As previously mentioned, in this embodiment, the specific modulator carrier frequency signal 23 and the specific demodulator carrier frequency signal 24 are selected out of a plurality of modulator carrier frequencies and a plurality of demodulator carrier frequencies prepared in advance in accordance with the control signal through the control channel 5 between the privacy communication devices; therefore, especially when the specific modulator carrier frequency signal 23 and the demodulator carrier frequency signal 24 are varied in accordance with the control signal on the control channel information 5*a* at arbitrary intervals of time, a third person cannot easily identify the modulator carrier frequency signal 23 and the demodulator carrier frequency signal 24, and consequently, the secrecy of the conversations is enhanced. The arbitrary intervals of time may mean intervals either of fixed period of time or of indeterminate period of time. In this case, the control device 20 transmits or receives the control signal on the control channel 5 at fixed or indeterminate intervals. The frequencies of the modulator carrier and the demodulator carrier may be set at the first stage of the communication without updating the frequencies thereafter. In this case, the control device 20 transmits or receives the control signal on the control channel 5 only once in the first stage of the communication.

Voice signals are transmitted or received by radio with the frequency spectrums of the voice signals inverted by the ring modulator 8 and the ring demodulator 14; therefore, even if somebody else receives the voice signal, it is difficult to identify the speakers.

Since the control channel information 5*a* on the control channel 5 is employed to select ones out of a plurality of modulator carrier frequencies and a plurality of demodulator carrier frequencies, the voice channel 4 can all be used only for the voice signal, and naturally, not so much degradation of tone quality occur. Meanwhile, the voice channel 4 may be used for transmitting and receiving the control signal; however, if so, the quality Of the voice signal is degraded.

While in this embodiment voice signals are transmitted by radio with the voice signals inverted by the ring modulator 8 and ring demodulator 14, they may be transmitted and received by radio with the voice signals inverted by a modulator and a demodulator but the ring modulator 8 and the ring demodulator 14.

Furthermore, setting the modulator carrier frequency signal 23 and the demodulator carrier frequency signal 24 applied to the ring modulator 8 and the ring demodulator 14, respectively, to the identical frequency, a signal modulated in the ring modulator 8 can be accurately reproduced after demodulating it in the ring demodulator 14. However, setting the modulator carrier frequency signal 23 and the demodulator carrier frequency signal 24 to different frequencies, voice inputted can be turned to a higher or lower tone in order to make it difficult for somebody else to identify the speakers.

Also, while in this embodiment an example employing the two privacy communication devices has been explained, the similar effects can be obtained even if more than two privacy communication devices are employed.

While the invention has been shown and described in detail, the foregoing description is in all aspects illustrative and not restrictive. It is therefore understood that numerous modifications and variations can be devised without departing from the scope of the invention.

What is claimed is:

1. A privacy communication device, comprising:

a modulator for modulating a voice signal by using a carrier before transmission by radio;

a demodulator for demodulating a voice signal by using a carrier after reception by radio;

carrier generating means for producing carrier of a specific frequency specified in accordance with a control signal out of a plurality of frequencies prepared in advance and applying it to said modulator and said demodulator; and control signal transmitting and receiving means for transmitting and receiving said control signal by radio through a channel different from a voice channel, wherein said control signal transmitting and receiving means transmits and receives said control signal at certain fixed intervals.

2. A privacy communication device in accordance with claim 1, wherein said carrier generating means gives carriers of the same frequency to said modulator and said demodulator.

3. A privacy communication device in accordance with claim 1, wherein said carrier generating means is consisted of modulator carrier generating means for giving a carrier to said modulator and demodulator carrier generating means for giving a carrier to said demodulator.

4. A privacy communication device in accordance with claim 3, wherein said modulator carrier generating means and said demodulator carrier generating means generate carriers with the same frequency.

5. A privacy communication device in accordance with claim 1, wherein said control signal transmitting and receiving means does not transmit said control signal unless otherwise said privacy communication device has a priority to other privacy communication device.

6. A privacy communication device, comprising:

a modulator for modulating a voice signal by using a carrier before transmission by radio;

a demodulator for demodulating a voice signal by using a carrier after reception by radio;

carrier generating means for producing carrier of a specific frequency specified in accordance with a control signal out of a plurality of frequencies prepared in advance and applying it to said modulator and said demodulator; and control signal transmitting and receiving means for transmitting and receiving said control signal by radio through a channel different from a voice channel, wherein said carrier generating means gives carriers of different frequencies to said modulator and said demodulator.

7. A privacy communication device in accordance with claim 6, wherein said control signal transmitting and receiving means transmits and receives said control signal only once in first stage of communication.

8. A privacy communication device in accordance with claim 6 further comprising a control device which generates a carrier selection signal in response to said control signal inputted thereto, said carrier selection signal being to be given to said carrier generating means.

9. A privacy communication device in accordance with claim 8, wherein said carrier selection signal is outputted in parallel state onto a plurality of carrier selection signal lines.

10. A privacy communication device in accordance with claim 8, wherein said carrier generating means is consisted of a programmable frequency divider.

11. A privacy communication device in accordance with claim 10, wherein said carrier generating means comprises:

a more-than-one bit counter having a reset signal input terminal;

a plurality of exclusive OR circuits which receives a more-than-one bit output signal from said more-than-one bit counter and a plurality of carrier selection signals from said control device, respectively;

an OR circuit which generates an output signal according to signals given thereto from said plurality of exclusive OR circuits and gives said signal to a reset signal input terminal of said more-than-one bit counter; and a frequency divider which generates and outputs said carrier of a specific frequency which is to be given to said modulator and said demodulator, according to said output signal from said OR circuit.

12. A privacy communication device in accordance with claim 11, wherein said frequency divider is a ½ divider.

13. A privacy communication device, comprising:

a modulator for modulating a voice signal by using a carrier before transmission by radio;

a demodulator for demodulating a voice signal by using a carrier after reception by radio;

carrier generating means for producing carrier of a specific frequency specified in accordance with a control signal out of a plurality of frequencies prepared in advance and applying it to said modulator and said demodulator; and control signal transmitting and receiving means for transmitting and receiving said control signal by radio through a channel different from a voice channel, wherein said carrier generating means consists of modulator carrier generating means for giving a carrier to said modulator and a demodulator carrier generating means for giving a carrier to said demodulator and wherein said modulator carrier generating means and said demodulator carrier generating means generate carrier with different frequencies.

14. A privacy communication device, comprising:

a modulator for modulating a voice signal by using a carrier before transmission by radio;

a demodulator for demodulating a voice signal by using a carrier after reception by radio;

carrier generating means for producing carrier of a specific frequency specified in accordance with a control signal out of a plurality of frequencies prepared in advance and applying it to said modulator and said demodulator; and control signal transmitting and receiving means for transmitting and receiving said control signal by radio through a channel different from a voice channel, wherein said control signal transmitting and receiving means transmits and receives said control signal at indeterminate intervals.

* * * * *

UNITED STATES PATENT AND TRADEMARK OFFICE

CERTIFICATE OF CORRECTION

PATENT NO. : 5,181,246

DATED : January 19, 1993

INVENTOR(S) : MIKI

It is certified that error appears in the above-identified patent and that said Letters Patent is hereby corrected as shown below:

On the title page:

In the "ABSTRACT", lines 5 and 11, change "democulator" to --demodulator--.

Signed and Sealed this

Fifteenth Day of February, 1994

*Attest:*

*Attesting Officer*

Bruce Lehman

BRUCE LEHMAN

*Commissioner of Patents and Trademarks*